United States Patent [19]

Schultz

[11] 3,966,075

[45] June 29, 1976

[54] CARGO CONTAINER

[76] Inventor: Gerhard L. Schultz, 7271 Natal Drive, Westminster, Calif. 92683

[22] Filed: Jan. 10, 1975

[21] Appl. No.: 540,171

[52] U.S. Cl. ..... 220/1.5; 105/366 E; 105/393; 220/8; 220/17; 220/23.4; 296/26

[51] Int. Cl.[2] ..... B65D 87/02; B65D 21/02

[58] Field of Search ..... 220/1.5, 17, 23.4, 8; 206/514, 516; 105/366 A, 366 B, 366 C, 366 E, 393; 296/35 A, 26; 217/3 R, 65, 5, 6, 17; 280/415 R; 24/221 R

[56] References Cited

UNITED STATES PATENTS

| | | | |
|---|---|---|---|
| 2,665,938 | 1/1954 | McCrossen | 296/35 A |
| 2,729,355 | 1/1956 | Gaston | 217/65 |
| 2,956,705 | 10/1960 | Clingman | 217/65 |
| 3,116,085 | 12/1963 | Ottley | 296/26 |
| 3,138,398 | 6/1964 | Silverman | 105/366 C |
| 3,162,320 | 12/1964 | Hitch et al. | 220/23.4 |
| 3,317,219 | 5/1967 | Hindin et al. | 220/23.4 |
| 3,342,523 | 9/1967 | Lutgen | 105/393 |
| 3,368,838 | 2/1968 | Reich | 24/221 R |
| 3,383,005 | 5/1968 | Abolins | 220/23.4 |
| 3,386,600 | 6/1968 | Betjemann | 220/1.5 |
| 3,456,829 | 7/1969 | Glassmeyer | 220/1.5 |
| 3,684,122 | 8/1972 | Bonomi | 220/1.5 |

FOREIGN PATENTS OR APPLICATIONS

| | | | |
|---|---|---|---|
| 554,704 | 2/1957 | Belgium | 24/221 RC |

*Primary Examiner*—William Price
*Assistant Examiner*—Allan N. Shoap
*Attorney, Agent, or Firm*—Georges A. Maxwell

[57] ABSTRACT

The combination of dimensionally standard cubical box-like cargo containers and dimensionally substandard rectangular, box-like receivable cargo containers adapted to be selectively used independent of and engaged within standard cargo containers, said standard cargo containers having standard operative mounting blocks at their eight exterior corners in standard disposition and relative spacial relationship, said receivable containers having standard apertured mounting blocks with carrier means normally related to their eight exterior corners in standard disposition and spacial relationship whereby the receivable containers are compatible with and can be used in cooperative relationship with standard containers; said apertured mounting blocks with carrier means being operable to selectively position the blocks in sub-standard spacial relationship whereby they are out of interferring relationship with related standard containers when the receivable containers are received by and arranged within the standard containers.

8 Claims, 11 Drawing Figures

B'
E'
I
51
U
C'
M'
50
N
O

U2
50 2
51 2
52 2
B2
M2
C2
I
O
E
B
10
11
50 3
51 3
52 3
53 3
54 3
55 3
M3
C3
B3

CARGO CONTAINER

This invention has to do with an improved cargo container means and is particularly concerned with the novel combination of two interengageable or nestable cargo containers, each with structurally and dimensionally standardized cargo container mounting means and/or structure.

As is well known to those skilled in the art of cargo handling and transportation, it has become common practice to provide large, unitary, transportable and re-useable cargo containers in which cargo or goods to be transported are arranged or placed. Such containers, with cargo deposited therein, are transported by truck, train, ship and by aircraft, from one location to another, as, for example, from the geographic location of the seller of the cargo to the location of the buyer of said cargo.

The containers above referred to have been found to be highly desirable in use since they eliminate handling and/or working with the cargo during the course of its transit from one place to another and since the containers can be and securely sealed so as to protect the cargo from damage by the atmosphere and the like and so that the cargo is protected against damage and/or theft by unauthorized persons in the course of transit.

The containers provided by the art here concerned with are elongate, box-like structures with access doors at one of their ends and have become nationally and internationally standardized (as by the "International Standards Organization"), with respect to dimensional limits and with respect to those mounting means which are provided to effect secure and dependable mounting of the containers on transport vehicles and vessels which are adapted to receive and carry them, and to effect dependable and secure interengagement of such containers in side-by-side, end-to-end and vertical stacked relationship with each other, as when a multiplicity of such containers are transported together.

The standardized mounting means referred to above consists of cast or fabricated steel cubical corner blocks which are engaged and securely fixed in the eight corners of the modular (uniform in exterior dimensions), elongated, rectangular, box-like containers, with their outwardly disposed or exposed surfaces substantially flush with their adjacent related surfaces of the containers. The standard mounting blocks are or can be said to be substantially hollow and are provided with apertures in their exposed surfaces to cooperatively receive compatible orienting pins and/or locking devices on related containers, container handling and supporting structures and the like.

While the art or practice of providing and using cargo containers have proven to be extremely economical and to afford many notable benefits, it has been found that great economic losses are experienced and result from "dead-heading" such containers, that is, the moving and/or transportation of such containers from one location to another when empty. Such dead-heading of cargo containers is frequently experienced and is the result of situations where the quantity, amount and/or volume of cargo being delivered to a location, by containers, is greater than or exceed the quantity, amount or volume of cargo being shipped from that location. In such cases, the extra or excess containers cannot be left or abandoned at such a location, but must be shipped or transported, empty, to a location where they can be used and are needed. The space occupied and the work associated with the dead-head handling or shipping of containers, that is, the returning of empty containers to their points of origin, represents a material waste as regards space and work effort and results in substantial economic losses.

It has been determined that a great saving of space, time and money could be gained if the number of dead-head transporting of cargo containers could be reduced by any appreciable or noticeable extent and that a means whereby a reduction of dead-head operations or events could be effected in the art now under consideration would constitute a material advance in the art.

In accordance with the above, it is an object of the present invention to provide an improved cargo container means whereby dead-head operations can be easily, effectively and economically reduced by as much as 50%.

It is another object and feature of my invention to provide a novel receivable cargo container, the outside dimensions of which substantially correspond with the inside dimensions of a relatable standard cargo container whereby the receivable container can be cooperatively arranged within a related empty standard container, and a receivable container which is provided with novel mounting means at its corners that include standard mounting blocks, which are such that they can be arranged in the same special relationship as are the mounting blocks of a standard container when the receivable container is not within a related standard container. Further, it is an object of the invention to provide mounting means blocks which are such that they can be arranged to occur within the outside limits of the receivable container when that container is arranged within, or is prepared for arrangement within a related standard container.

It is an object and feature of the instant invention to provide novel cargo container mounting means occurring at the eight corners of a receivable container of sub-standard dimensions and which includes substantially standard cargo container, corner, mounting blocks and means adapted to releasably secure the corner blocks relative to that container in the same relative spacial relationship, one relative to the other, as are the corner mounting blocks of a standard cargo container.

An object and feature of this invention is to provide a structure of the character referred to above wherein the means releasably positioning the corner blocks to the related containers in predetermined spacial relationship comprises block mounting brackets and fastening means releasably securing the brackets to the container in predetermined relationship therewith.

It is another object and feature of the invention to provide a structure of the character referred to wherein the means releasably positioning the corner blocks in predetermined spacial relationship comprises corner block supporting means or carriers shiftably carried by the container and shiftable from a normal position where said blocks occur in said standard spacial relationship to retracted position where the blocks occur within the inside dimensional limits of a standard cargo container with which the receivable container is to be arranged.

The foregoing and other objects and features of my invention will be fully understood from the following detailed description of typical preferred forms and applications of my invention, throughout which description reference is made to the accompanying drawings; in which.

Figures 4, 5, 6, 7, 8:
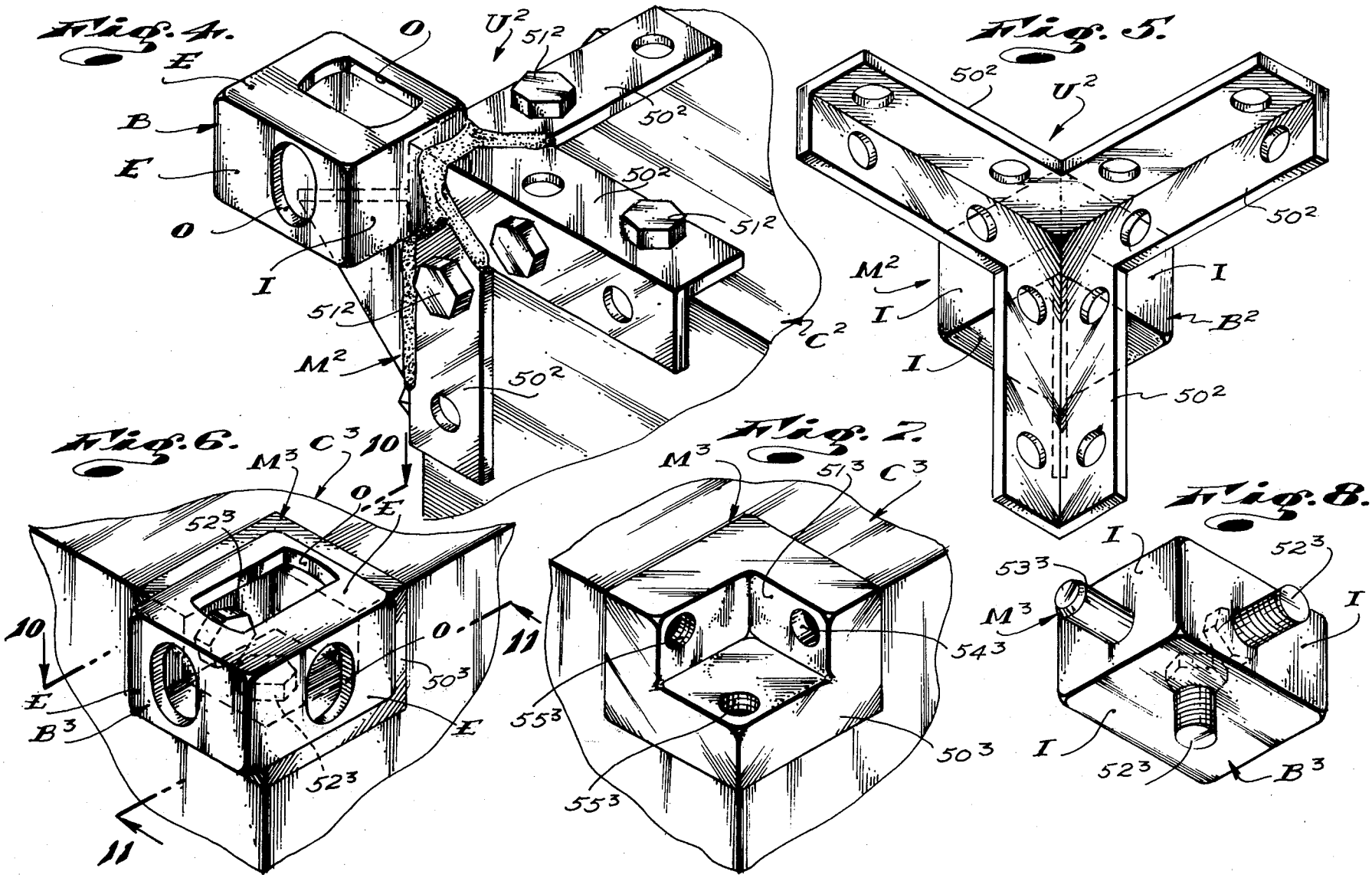
FIGS. 4 and 5 are isometric views of another form of mounting means.
FIG. 6 is an isometric view of yet another form of mounting means.
FIGS. 7 and 8 are isometric views of parts of the structure shown in FIG. 6.
Figure 9:
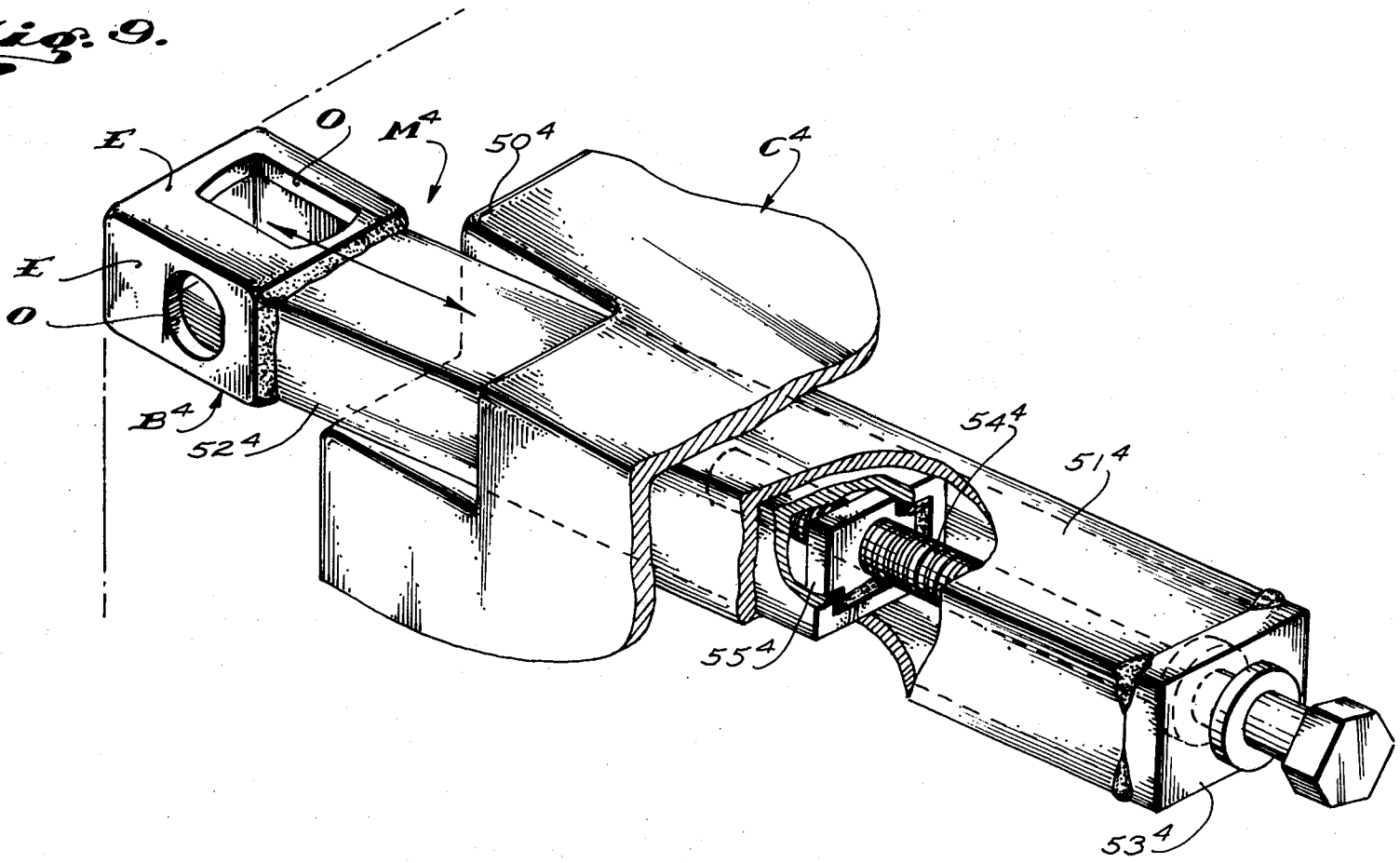
Figure 10:
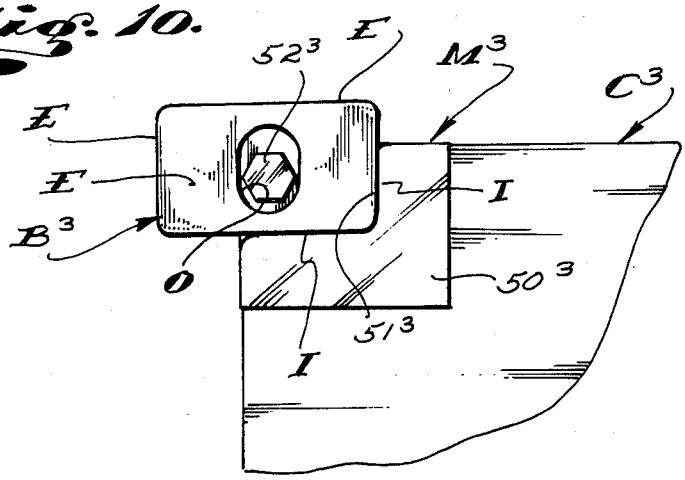
Figure 11:
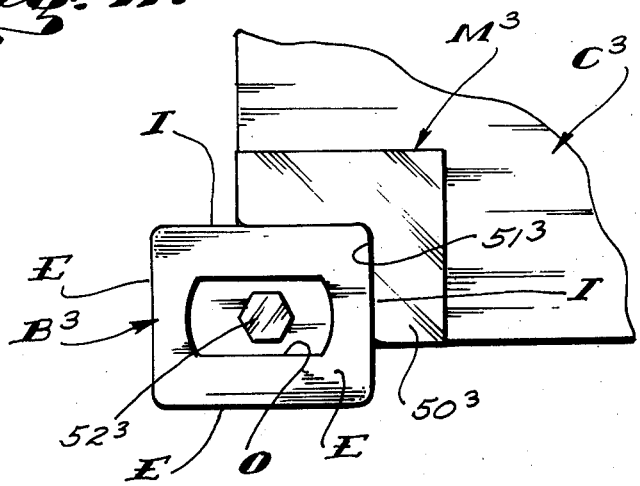

FIG. 9 is an isometric view of yet another form of mounting means provided by the present invention; and FIGS. 10 and 11 are views taken as indicated by lines 10—10 and 11—11 on FIG. 6.

Referring to the drawings, the ordinary, standard cargo container C comprises an elongate box-like body with rectangular top, bottom, and sides, a flat rear end wall 13 and an open front end 14 having a door-like closure means 15 related thereto. The closure means 15 can and do vary in form, but typically comprise a pair of doors 16 normally overlying the right and left halves of the open front end of the container body. The doors are hinge-mounted to the front, vertical edges of the side walls 12 and are adapted to be pivotally moved forwardly and laterally outwardly to open positions where they are clear of the open front end of the body.

In other, less common, forms of containers, accesses to the interior thereof is effected by release and removal of one or more of the walls which operate to normally define the containers.

In practice, the structural details of the bodies of cargo containers can and do vary widely. For example, some containers are simple boxes established of plywood panelling, fixed to and about a wood or metal frame, while others are established of or comprise structurally sound, laminate wall structure with wood and/or metal skins and cores of insulating material or the like and are related one to the other by special corner brackets, stringers and the like, to establish integrated units.

In carrying out the present invention, the structural details of the box-like container body or bodies and the details of the closure and/or access means provided therewith can vary widely in form without in any way affecting the novelty of the invention. It is only necessary and/or required that the container body be a sound, stable, strong and durable structure.

As of this date, national and international standards have been established with regards to the dimensions of cargo containers. While several standard sizes are provided for, the most common container is 96 inches wide, 96 inches high and can be 480 inches, 359 inches, 238 inches or 117 inches long.

Next, cargo containers are provided with mounting means M to facilitate orienting and releasably securing them to supporting structures, such as the beds of trucks, railroad cars, ship decks and the like and with which standardized devices or fixtures, related to manipulative means, such as cranes, hoists, lift trucks and the like, can be related to effect moving the containers into and out of engagement with their related supporting structures or transporting means.

The mounting means M further serve to orient and releasably secure adjacent related containers when the containers are arranged in side-by-side, end-to-end and/or vertical stacked relationship.

The mounting means referred to above, in accordance with established national and international standards comprise substantially cubical, corner blocks B, rigidly fixed in the 8 corners of the container bodies, in recessed relationship therewith and so that their three flat exposed or outwardly disposed surfaces E are substantially flush with the surfaces of their related side, end and top or bottom surfaces of the body. In practice, the exposed flat surfaces of the corner blocks are on planes spaced a limited distance outward of their related container body surfaces.

The corner blocks are essentially hollow fabricated or cast steel units and the exposed surfaces E thereof are provided with apertures or openings O of standard size and shape to cooperatively receive special orienting pins, latching devices, hooks and various other hardware which is provided and which is required to put the containers into effective service and use.

The other, hidden or inside surfaces I of the corner blocks B are fixed to their related container bodies as by welding them to a metal frame of the containers when such a frame is provided; by welding them to metal plates or the like which are incorporated in the structure of the container bodies when no definable frame is provided, or by any other suitable means which is effective to properly fix and secure the blocks with the container bodies.

From the foregoing, it will be apparent that a standard cargo container as it affects the instant invention is a simple box with an access opening (for example) at one end, is provided with a suitable closure means for its access opening and is provided with apertured mounting blocks at its eight corners. The configuration and dimensions of the container body, the corner blocks and the apertures in the blocks are standardized. Apart from the foregoing, the form and details of construction of such containers can vary widely as desired or as circumstances require.

It is to be noted that in practice, cargo containers of the character here concerned with are or can be constructed to establish and/or include special means to facilitate the effective engagement of the container with the tines of fork-lift trucks and the like and with special means to effect the securing of such containers in a fixed position as by means of deck mounted latching devices or tethers. Such secondary or collateral features that are or can be incorporated in such containers form no part of and in no way affect the novelty of my invention. Accordingly, disclosure and further consideration of such features can and will be avoided.

The standard container C here concerned with and shown in the drawings has interior dimensions which are less than the standard exterior dimensions thereof by an extent determined by the cumulative thickness of the opposing walls of the body. For example, if the top wall is 2 inches thick and the bottom wall is 4 inches thick, the interior vertical extent of the container is 6 inches less than the standard outside vertical extent of the container. If the side and end walls (including the closure or doors) are 2 inches thick, the interior of the container is 4 inches narrower and 4 inches shorter than the standard lateral and longitudinal external dimensions of the container.

In furtherance of and in carrying out my invention, I provide a novel, special inside or receivable container C′, with (substantially standard) modified mounting means M′, that is, mounting means which are compatible with standard cargo container mounting means. The body of the container C′ is or can be substantially the same as the outside container C or any other standard container with the exception that its outside dimensions are substantially equal to or less than the inside dimensions of the outside, standard container C and is such that it is freely receivable in or by the outside container C. That is, the receivable container C′ is smaller than the outisde standard container C and can be moved into and positioned within the container C.

To this point, from a simplistic point of view, the invention provides two interengageable or nestable boxes, there being an outside box C in the form of a standard cargo container with standard cargo container mounting means M, and an inside, smaller, receivable container C′ which is shiftable into and out of engagement within the container C and which is provided with substantially standard modified cargo container mounting means M′.

At this point, it is to be particularly noted that the mounting means M of the outside container C are and must be arranged in predetermined spacial relationship with each other and relative to the exterior dimensions of the container C whereby the exposed surfaces E thereof occur at or outward of their related exterior planes or surfaces of the container body. This specific and predetermined spacial relationship of the mounting means or corner blocks is an indispensable and critical feature in the cargo container art as it makes possible the effective, efficient and dependable handling, manipulating and correlating of such container with and by means of the standardized support means and equipment designed and provided for use in conjunction therewith and which, combined with the containers themselves, constitute what is in fact a cargo handling system.

In light of the above, it will be apparent that if the corner blocks of the mounting means M′ of the container C′ were fixed in standard spacial relationship and such that they could and would establish cooperative relationship with the means M of standard containers, such as the container C, and with standard support means and equipment, the corner blocks of the means M′ would create obstructions that would prevent the container C′ from entering the container C. On the other hand, if the corner block of the means M′ of the containers C′ were fixed relative to the containers C′ in the same relative relationship therewith as are the blocks B with the container C, the container C′ might be engaged in the container C but the resulting spacial relationship of the means M′ or the blocks thereof would be incompatible with the means M of standard containers and incompatible with the support means and equipment provided for the handling of such containers.

In light of the above, the modified cargo container mounting means M′ for the receivable container C′ that I provide is such that the corner blocks or the mounting means M′ can be selectively related with the container C′ in a normal or standard spacial relationship or in an actuated or retracted spacial relationship wherein the corner blocks thereof occur within the interior dimensional limits of the container C. With the above noted capability, it will be apparent that the means M′ can be selectively adjusted or set whereby the container C′ can be handled and used (independently) in a conventional cooperative relationship with standard containers and related support means and equipment therefore, or can be adjusted or set whereby the containers C′ can be cooperatively engaged within and carried by related standard containers C.

To the above end, the means M′ include substantially standard cargo container mounting blocks B′ and novel or special carrier means N for securing the blocks B′ to the container C′. The carrier means N can vary widely in form and construction and can include means which releasably secure the blocks B′ to the container or means which movably or shiftably mount the said blocks to the container C′.

In those cases where the means N for blocks B′ releasably secure the blocks to the container C′, the blocks B′ must be removed from the container C′ and stored within the container, or otherwise saved, when the container C′ is to be arranged in a related standard container. In those cases where the means N for the blocks B′ movably or shiftably mount the blocks on the receivable container, the work of removing and storing or saving the mounting means is effectively avoided.

Figure 1:
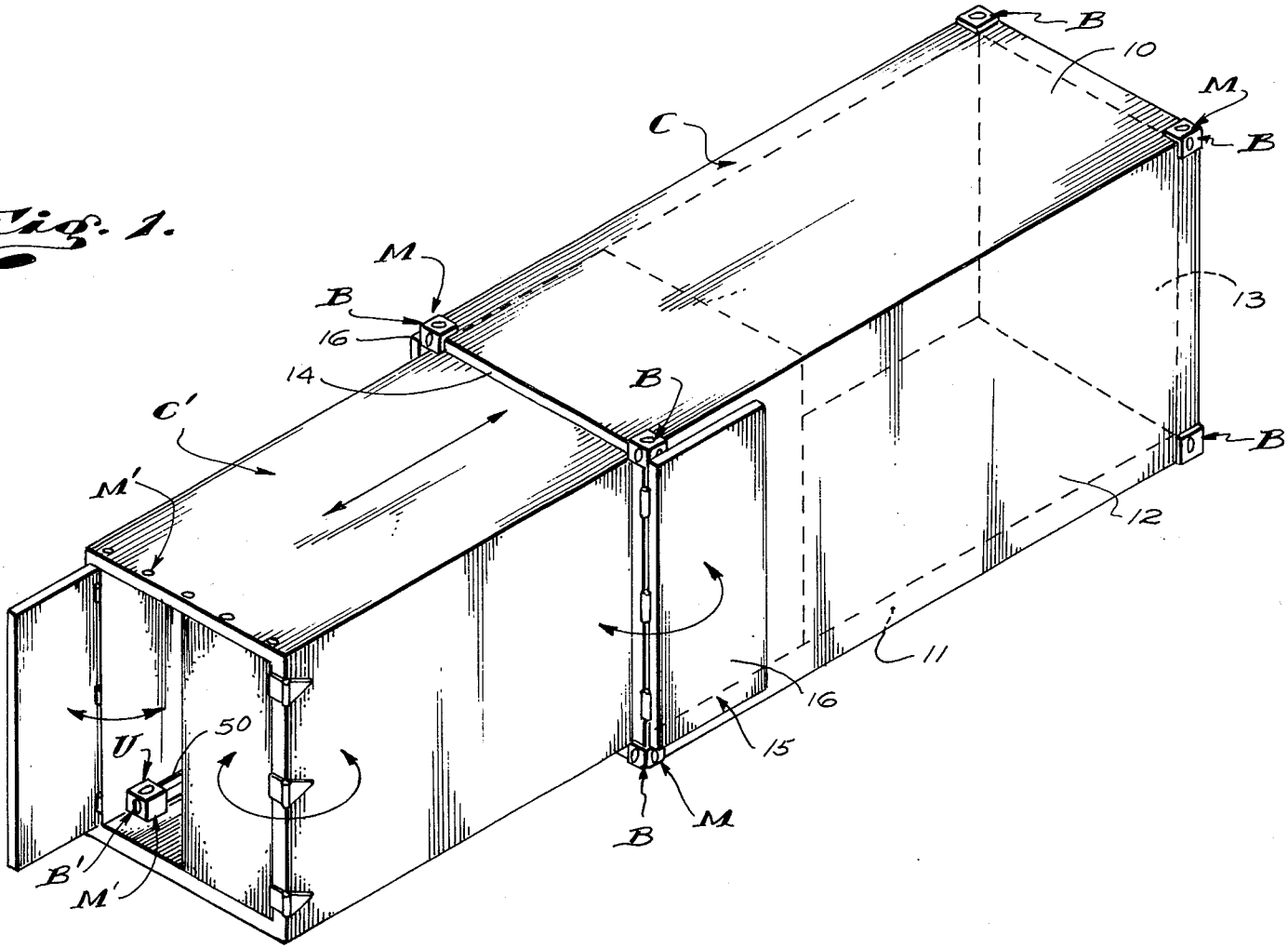
FIG. 1 is an isometric view of a standard container with a receivable container partially engaged therein.

In FIG. 1 of the drawings, I have shown a receivable container C′, with its mounting means M′ in a position whereby the container C′ can be engaged within a standard container and have shown the container C′ partially engaged in a standard container C.

Figures 2, 3:
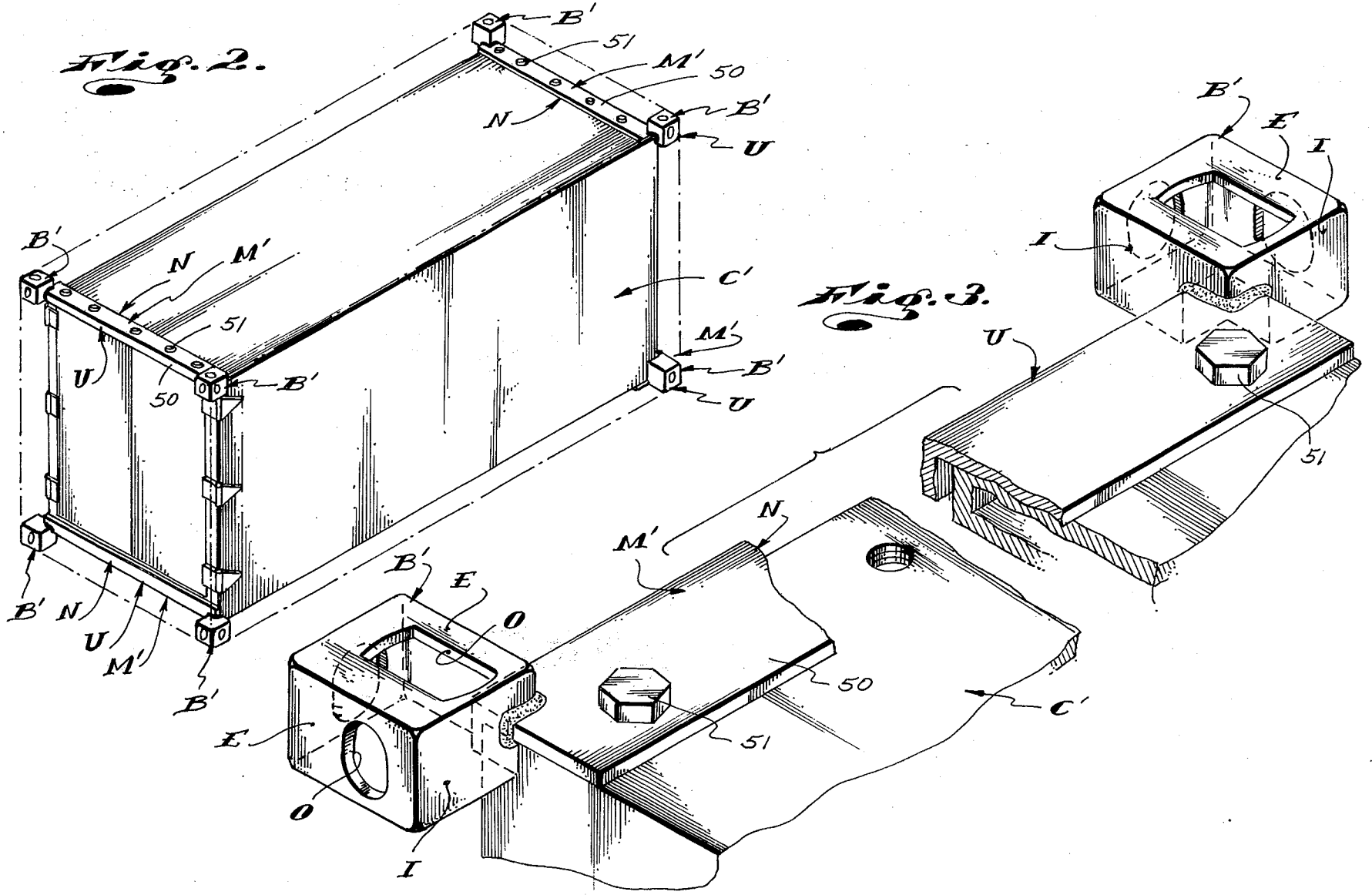
FIG. 2 is an isometric view of a receivable container embodying the present invention.
FIG. 3 is an isometric view of one form of mounting means that is provided by my invention.

In FIG. 2 of the drawings, I have shown the container C′ with its mounting means M′ arranged in novel, standard spacial relationship and in that relationship whereby the container C′ is rendered compatible with other standard containers and the support equipment that is provided for use in connection with such containers.

In FIG. 2 and 3 of the drawings, I have shown one preferred form of carrier means N for the blocks B′ of the mounting means M′.

The means N consists of a metal angle iron stringer or carrier 50 adapted to be removably engaged with a related horizontal edge of the container C′ and releasably secured to the container by screw fasteners 51 or other suitable quick release fastening devices and a standard container mounting or corner block B′ fixed to each end of the stringer or carrier 50. The blocks B′ are arranged whereby their apertured exterior surfaces E occur on parallel planes spaced laterally, vertically or axially outward from the planes of their related surfaces of the container C′ and in standard spacial relationship with each other. Each noted carrier 50 and pair of blocks B establish a unit U and four such units are provided for the container C′ whereby corner blocks B′ are normally related to all eight corners of the container, as is required when the container is to be put to standard use.

When the container C′ is to be arranged within the container C, the noted stringer and block units U are removed from their related edges of the container and stored within the container C′ as shown in FIG. 1 of the drawings, or are otherwise saved. When the mounting means M′ are thus removed, the container C′ can be slidably engaged within the container C and transported within (see FIG. 1).

When the container C′ is arranged within the container C, as noted above, it will be apparent that the inside, receivable container C′ can be filled or loaded with cargo and that only the standard, outside container C need be dead-headed.

In FIGS. 4 and 5 of the drawings, I have shown another form of mounting means $M^2$. The mounting means $M^2$ comprises a separate unit $U^2$ for each corner of the container $C^2$. For the purpose of this disclosure only one container corner and related unit $U^2$ is being shown in the drawings.

Each unit $U^2$ comprises a corner block $B^2$ and a plurality of right angularly related angle iron arms or carriers $50^2$ fixed to and projecting from the block to extend longitudinally along the three edges of the container which converge to establish the container corner with which the unit is related. The carriers $50^2$ are releasably secured to the container $C^2$ by screw fasteners $51^2$ or desired quick disconnect fastening means, which fasteners or means preferably engage or are related to an interior metal frame of the container (not shown).

It will be apparent that the three related carriers $50^2$ are integrally joined and cooperated to form what is in essence a removable container corner engaging cap and can be effectively and properly called or referred to as a corner cap.

In FIGS. 6 through 8, 10 and 11, I have shown yet another form or embodiment of mounting means $M^3$. The mounting means $M^3$ comprises carriers $50^3$ in the form of metal corner caps permanently fixed to and about the corners of the container and having recesses $51^3$ to cooperatively receive substantially standard corner blocks $B^3$. The block $B^3$ related to each carrier $50^3$ is releasably secured in the recess $51^3$ by screw fasteners $52^3$ engaged through the three (3) inside or inwardly disposed walls I of the block (see FIG. 8 of the drawings) and into threaded fastener receiving openings $55^3$ in the opposing recess defining walls of the carrier (see FIG. 7 of the drawings). Access fo the fasteners $52^3$ is had through the openings or apertures O in the exterior walls E of the block.

In practice, and as shown in the drawings, one inner side of the block can be provided with an orienting pin $53^3$ engageable in an orienting opening $54^3$ in one wall of the recess, in stead or place of one of the above noted fasteners $52^3$.

This last form of the invention is particularly suitable for use in those cases where the relative size of the standard and receivable containers is such that the standard blocks are not whole outside the exterior limits of the receivable container when they are in standard spacial relationship with each other. Such a relationship is likely to occur when the walls of the standard container are relatively light and thin, the access opening thereof is wholly unrestricted when opened or uncovered and the receivable container is proportioned to slidably enter the standard container within small or close tolerances.

This last form of the invention is also desirable from the standpoint that only the small, relatively light and easy to handle blocks $B^3$ are removed, said blocks require little space within their related containers for storage and the fastener means provided therefor are useful and convenient to releasably secure the blocks within the container when stored therein.

Finally, in FIG. 9 of the drawings, I have shown another form of mounting means $M^4$ wherein a metal corner cap-like carrier $50^4$ is provided for each corner of the receivable container $C^4$. Each carrier $50^4$ is provided with an inwardly extending elongate rectangular duct $51^4$, the axis of which intersects the geometric center of the standard corner blocks $B^4$ related thereto. The corner block $B^4$ is provided with an elongate rectangular arm $52^4$ fixed thereto to project inwardly therefrom on a common axis with the duct $51^4$ of the carrier $50^4$ and is proportioned to slidably engage in said duct. The inner end of the duct is shown closed by an apertures end wall $53^4$ in which an advancing or drive screw $54^4$ is rotatably journaled. The screw $54^4$ extends longitudinally through the arm $52^4$ and is threadedly engaged in and through nut-like partition $55^4$ fixed in the arm whereby rotation of the screw advances the arm, with the block $B^4$ thereon, longitudinally inwardly or outwardly in and relative to the duct as desired or as circumstances require.

With this last described form of the invention, the corner blocks can be retracted from their normal spacial relationship to occur wholly within the outside limits of the receivable containers, without removal of the blocks or any other parts.

In addition to the above, it is possible, with this last form of the invention, to advance the corner blocks outwardly, when the receivable container is within a standard container so that the blocks engage the interior of the standard container to hold and stabilize the receivable container therein.

The only apparent shortcoming of this last described mounting means resides in the fact that a substantial amount of space within the receivable container is sacrificed to accommodate the ducts of the carriers.

It is believed to be abundantly clear and obvious that in practice, the screw means provided to advance the blocks inwardly and outwardly is a rather simplistic form of drive means for attaining the desired function and end and that in practice, a multiplicity of different forms of drive means can be substituted therefor without departing from the spirit of this invention. For example, the arms could be releasably secured in desired positions by means of set screws or the like engaged in and between the arms and ducts or could be advanced and set as desired by a suitable cam means or by a suitable link and lever means or device as desired, or as circumstances might require.

It is to be noted and understood that the angular disposition of the duct $51^4$ relative to the longitudinal axis of the container $C^4$ and the planes of the walls of the container, as shown in FIG. 9 of the drawings, shift longitudinally outwardly and at an angle whereby the top and side planes of the block move a limited distance vertically and laterally outwardly relative to their related walls of the container when the means $M^4$ is actuated. The movement is sufficient to shift the blocks outward to a position where the receiving container is functionally interengageable with a standard container and inward to a position where it can be placed within a standard container.

It will be apparent that in those cases or instances where greater relative movement of the blocks and containers is required, such movement can be affected or gained by changing the relative angle and the length of the arms and ducts, as circumstances require. For example, the arms and ducts could be disposed at 45° relative to their related end, side and top or bottom walls of the containers.

With the structures hereinabove described, it will be apparent that the sub-standard size receivable container or containers with their special and novel mounting means can be advantageously used separately to receive and transport cargo and with their mounting means in normal working position can be cooperatively related with other standard containers and cargo container receiving and handling means. It will be further apparent, that when desired, the mounting means of the receivable containers can be retracted or otherwise moved from their normal standard spacial relationship to a position within the exterior limits of their related containers and that when so positioned, the receivable containers can be effectively and advantageously engaged within a related standard container, to be transported thereby. When the receivable containers are engaged in standard containers, they can be employed to receive and transport cargo, as desired.

With the above combination and relationship of parts, it will be apparent that the problems and economic losses presently experienced in the cargo container art, as a result of having to transport empty containers to and from distant locations in order to handle disproportionate volumes and/or quantities of cargo moving to and from those locations, can be easily and effectively reduced to a material extent.

Having described only typical preferred forms and applications of my invention, I do not wish to be limited to the specific details herein set forth but wish to reserve to myself any modifications and/or variations that may appear to those skilled in the art to which this invention relates and which fall within the scope of the following claims:

Having described my inventon, I claim:

1. A substantially rectangular receivable cargo container in combination with and selectively cooperatively engageable with the interior and exterior of a substantially rectangular standard cargo container having standard exterior dimensions, a cargo-receiving interior, an access opening at one side thereof and having substantially cubical standard mounting blocks at its exterior corners in fixed predetermined standard spacial relationship with each other and each having three outwardly disposed apertured exterior sides arranged in substantially parallel planes with and spaced outward from related sides of the standard container, said receivable container being smaller in exterior dimension than the interior of said standard container and includes mounting means comprising substantially standard cubical mounting blocks related to the exterior corners of the receivable container and carrier means between said blocks and said container to secure said blocks relative to the receivable container in a first position wherein said blocks are in standard spacial relationship with each other and operable to position said blocks in a second position wherein said blocks are within the dimensional limits of the interior of said standard container, whereby said receivable container can be cooperatively related with the exterior of said standard container and other like adjacent standard containers with their related mounting blocks in cooperative relationship with each other when the mounting blocks of the receivable container are in said first position and said receivable container can be cooperatively received by and positioned within the standard container when said blocks are in said second position.

2. A structure as set forth in claim 1 wherein the carrier means includes elongate stringers normally extending longitudinally of edges of the receivable container extending between related pairs of corners thereof and selectively positionable remote from said edges and corners, each stringer having its ends fixed to the corner blocks at its related pairs of corners and fastener means normally releasably securing the stringers to said receivable container.

3. A structure as set forth in claim 1 wherein the carrier means includes corner engaging caps fixed to the corner blocks and engaged about the corners of the receivable container with which each block is related when said blocks are in said first position and fastener means engageable with and between the caps and said container to releasably secure the caps to the container.

4. A structure as set forth in claim 3 wherein each corner engaging cap comprises three elongate right angularly related angle iron arms, each disposed to normally engage about and extend longitudinally of one of three edges of the receivable container defining the corner with which the cap is related.

5. A structure as set forth in claim 1 wherein the carrier means for the blocks comprises a container corner engaging cap for each block engaged about and fixed to the receivable container corner with which the block is normally related, occurring within the interior dimensional limits of the interiors of the standard containers and each having an outwardly disposed polygonal recess, each block having an inwardly disposed polygonal recess, each block having an inwardly disposed polygonal portion normally cooperatively engaged and seated in the recess of its related corner cap and fastener means engaged with and between the blocks and their related corner caps and normally releasably securing the blocks and corner caps together with said blocks in said first position.

6. A structure as set forth in claim 1 wherein the carrier means includes an arm support fixed to each block and projecting from the block toward the receivable containers and terminating within the exterior dimensional limits of that container, and operating means to shift the arms relative to said container whereby said blocks are selectively moved from said first and second positions.

7. A structure as set forth in claim 6 wherein said operating means includes an elongate duct at each corner of the container in axial alignment with and telescopically receiving the support arm related thereto.

8. A structure as set forth in claim 7 wherein said operating means further includes manually operable means engageable with and between the related arms and ducts to releasably maintain the arms and ducts in secure position when the blocks are in said first and second positions.

* * * * *